United States Patent [19]

Kersting

[11] Patent Number: 4,468,925

[45] Date of Patent: Sep. 4, 1984

[54] MODULAR ENGINE MANIFOLD CONSTRUCTION

[75] Inventor: Darrel Kersting, Black River Falls, Wis.

[73] Assignee: Nelson Industries, Inc., Stoughton, Wis.

[21] Appl. No.: 405,515

[22] Filed: Aug. 5, 1982

[51] Int. Cl.[3] ..... F01N 7/10

[52] U.S. Cl. ..... 60/322; 60/323

[58] Field of Search ..... 60/322, 323

[56] References Cited

U.S. PATENT DOCUMENTS

| | | | |
|---|---|---|---|
| 2,257,631 | 9/1941 | Wahlberg | 60/323 |
| 2,611,238 | 1/1950 | Fryer, Jr. | 60/322 |
| 2,635,418 | 4/1953 | Leach | 60/323 |
| 3,541,785 | 11/1970 | Wahnschaffe | 60/323 |
| 4,168,610 | 9/1979 | Engquist | 60/323 |
| 4,182,122 | 1/1980 | Stratton et al. | 60/322 |

*Primary Examiner*—Douglas Hart

*Attorney, Agent, or Firm*—Andrus, Sceales, Starke & Sawall

[57] ABSTRACT

A modular engine manifold construction comprising a series of cast metal headers, each having an inlet communicating with an exhaust gas port in the engine. Each header is also provided with a passage that extends through the headers and is located generally normal to the inlet. Stainless steel tubes are slidably mounted within the aligned passages and interconnect the headers. The ends of the tubes are provided with longitudinally extending slots which engage locating pins on the inner surface of the headers to prevent rotation of the tubes, yet permit longitudinal movement of the tubes relative to the header to accommodate heat expansion. The ends of the tubes are also provided with cut-out sections or notches which are aligned with the inlet in the header when the slots in the tubes are engaged with the locating pins. The assembled manifold is a non-welded construction formed of a minimum number of component parts.

9 Claims, 3 Drawing Figures

MODULAR ENGINE MANIFOLD CONSTRUCTION

BACKGROUND OF THE INVENTION

With large-size internal combustion engines, such as, for example, 12 cylinder diesel engines, the exhaust manifold is often formed of a series of interconnected, generally T-shaped castings, with the stem portion of each casting being connected to an exhaust gas outlet port of the engine. To permit expansion between the castings due to the high exhaust gas temperatures, it has been the practice in the past to form one arm of each T-shaped casting with an enlarged diameter which receives the smaller diameter arm of the next adjacent casting to provide a bell and spigot type slip joint. The arms of the casting are machined to extremely close tolerances to provide the sliding fit between the castings without the use of gaskets or seals. Because of the extensive machining, the conventional exhaust manifold is an expensive construction.

More recently, with higher temperature engines, the manifold castings have been formed of nickel alloys which further increases the overall cost of the manifold.

SUMMARY OF THE INVENTION

The invention is directed to an improved, modular exhaust manifold construction. The manifold consists of series of cast or forged metal headers, each of which has an inlet which is mounted in communication with an exhaust gas outlet port of the engine. Located at 90° to the inlet port is a passage that extends through the header and stainless steel tubes are slidably mounted within the aligned passages and serve to interconnect the headers.

Each end of each tube is provided with a longitudinally extending slot which engages a locating pin or abutment formed on the inner surface of the respective header, and the engagement of the slot with the pin serves to prevent rotation of the tube within the header, while permitting longitudinal movement of the tube to compensate for heat expansion. In addition, each tube is provided with a cut-out portion or notch which is aligned with the inlet in the header when the slot is engaged with the corresponding locating pin.

The manifold construction of the invention is composed primarily of two basic parts, the headers and the tubes which can be connected in any desired length or series to accommodate the requirements of the particular engine.

Standard stainless steel tubing is employed which does not require machining of the outer surface, and the tubes are fitted in close tolerance within the aligned openings in the machined headers so that no seals or gaskets are required. The sliding fit between the tubes and the headers accommodates heat expansion of the tubes when exposed to the high temperature exhaust gas.

The manifold construction of the invention does not require welding or mounting flanges or other component parts onto either the headers or the tubes, and as a consequence, there is no need for secondary machining operations which are often required due to warpage that occurs during a welding operation.

The manifold construction of the invention, is considerably less expensive than conventional types, not only because of the reduction in machining, but also due to the fact that carbon steel, as opposed to more expensive alloys, can be used for the headers, along with standard size stainless steel tubing.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
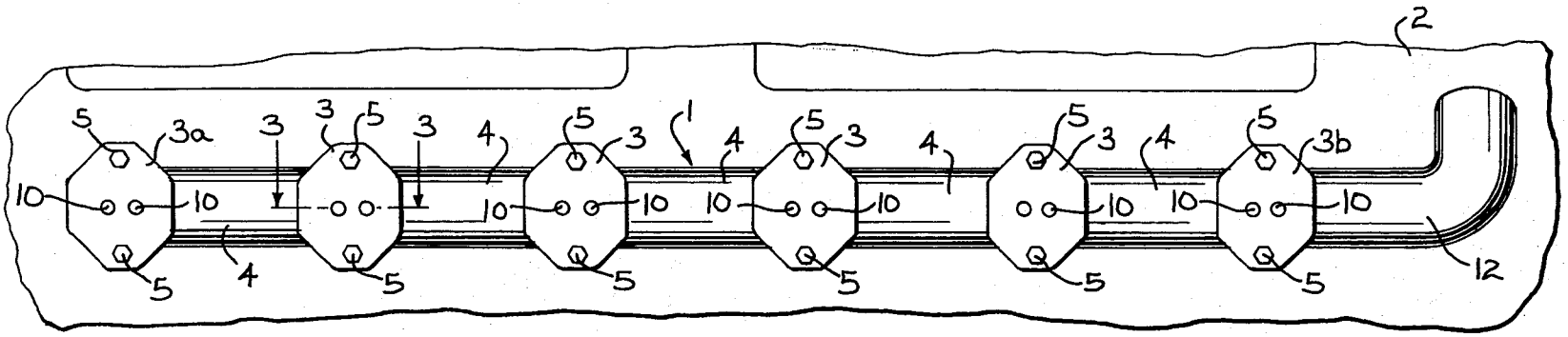
FIG. 1 is an enlarged size elevation showing the modular manifold construction as associated with an engine.

FIG. 1 illustrates the modular exhaust manifold construction 1 of the invention, as associated with a typical large internal combustion engine 2. The manifold construction 1 includes a plurality of cast or forged metal headers 3, preferably formed of carbon steel, which are interconnected by straight lengths of stainless steel tube 4.

Figure 3:
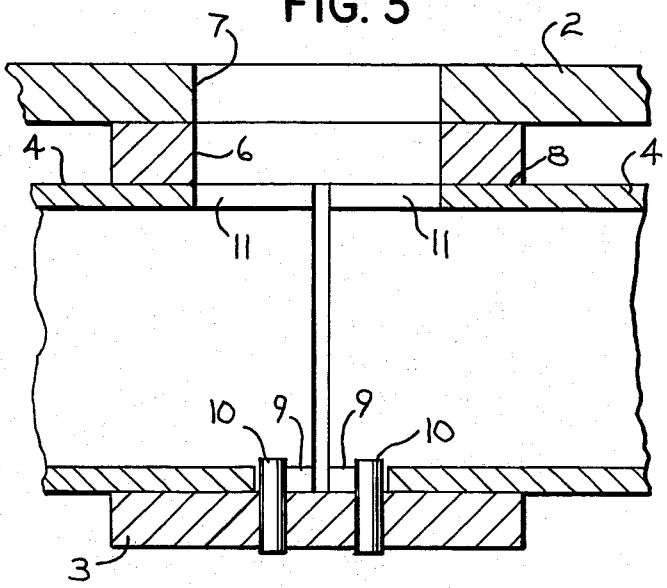
FIG. 3 is a section taken along line 3—3 of FIG. 1.

Each header 3 is connected to the engine 2 through a pair of bolts 5 that extend through bolt holes located at opposite portions of the header and are threaded into the engine. As best shown in FIG. 3, each header 3 is provided with an inlet 6 which is mounted in communication with an exhaust gas outlet port 7 in the engine. In addition to inlet 6, each header is also formed with a passage or opening 8 which is disposed normal to the axis of inlet 6.

Tubes 4 are mounted for sliding movement within the passage 8 of each header. Tubes 4 are fitted in close tolerance with the machined passages 8 so that no seals or gaskets are required at the sliding joint.

Figure 2:
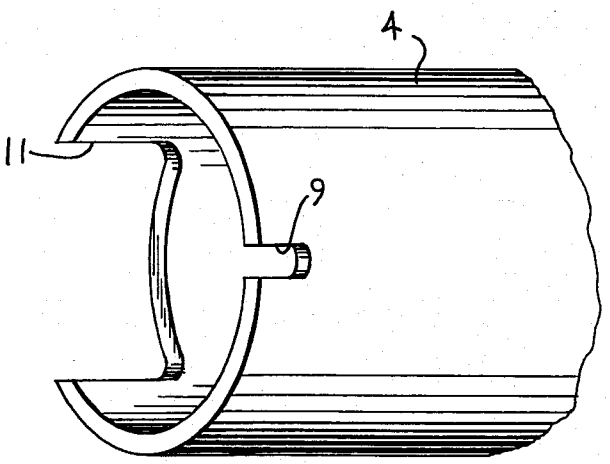
FIG. 2 is a perspective view of the end of one of the tubes.

As best illustrated in FIG. 2, the ends of each tube are formed with longitudinally extending slots 9, each of which is adapted to engage a pin or abutment 10 on the inner surface of the header. In the non-operating condition of the engine, the adjacent ends of tubes 4 are in slightly spaced relation, as best illustrated in FIG. 3. During operation of the engine, the tubes 4 will tend to expand and the gap or separation will permit tube expansion.

The engagement of slots 9 with pins 10 prevents rotation of tubes 4 with respect to headers 3 while permitting longitudinal or axial expansion of the tubes relative to the headers.

In addition to the slots 9, each end of tube 4 is formed with a recess or notch 11 which is aligned with inlet 6 when the slot 9 is engaged with the pin 10. The recesses 11 enable the exhaust gas to enter the header and pass into the tubes 4.

The header 3*a* at one end of the manifold is formed with only a single opening 8 on one side, as opposed to a through passage, as it is adapted to only receive one tube 4. At the outlet end of the manifold, a generally curved tube 12 is inserted within one end of the passage 8 in the header 3*b* and the curved tube conducts the exhaust gas from the manifold to a muffler or silencer.

The exhaust manifold construction of the invention is a non-welded construction which minimizes the use of stainless steel or other expensive alloys. The tubes 4 are formed from standard stainless steel tubing stock and require no external machining. Headers 3 can be formed of carbon steel. Except for the end units in the manifold, the entire manifold is formed of only two parts, namely headers 3 and tubes 4. Furthermore, it is not necessary to weld or otherwise attach any mounting flanges or other components to either the tube or the header, and as welding is eliminated, there is no necessity for secondary machining operations.

The sliding connection between the tubes 4 and headers 3 permits axial expansion of the tubes and engagement of the slots 9 with the pins 10 prevents rotation of the tubes and thus maintains alignment of the recesses 11 and the inlet 6 in the header.

As the manifold is a modular system any number of headers and tubes can be connected together to form a manifold of any desired length.

Various modes of carrying out the invention are contemplated as being within the scope of the following claims particularly pointing out and distinctly claiming the subject matter which is regarded as the invention.

I claim:

1. In a modular exhaust manifold construction, a plurality of headers, each header having an inlet disposed to be connected in communication with an exhaust gas port of an engine, each header also having a passage disposed at an angle to said inlet and extending completely through said header, a plurality of tubes interconnecting said headers, each tube having a uniform external diameter throughout its length, an end of each tube being slidably mounted within an end of each passage, whereby the ends of adjacent tubes are located in closely spaced proximity within the respective passage, said tubes being free to slide axially relative to said headers to accommodate heat expansion, and means interconnecting said headers and the respective tubes for preventing rotation of said tubes relative to the headers.

2. The construction of claim 1, wherein each header is provided with a pair of holes located at opposite sides of said inlet, and said construction includes connecting means disposed within said holes for connecting said header to the engine.

3. The construction of claim 1, wherein the ends of each tube are provided with recesses disposed in alignment with the inlet of the respective header so that exhaust gas can flow from said inlet into the interior of said tubes.

4. The construction of claim 1, wherein said means for preventing rotation comprises a pair of longitudinally spaced abutments disposed in said passage, the end of each tube having a longitudinally extending slot engageable with an abutment, the spacing between said abutments being such that when the abutments are engaged with the bottom of the slots the adjacent ends of the tubes will be spaced apart to thereby permit axial expansion of said tubes.

5. The construction of claim 4, wherein the ends of each tube are provided with recesses disposed in alignment with the inlet of the respective header when the slots are engaged with the respective abutments so that exhaust gas can flow from said inlet into the tubes.

6. In a modular exhaust manifold construction, a plurality of metal headers, each header having an inlet disposed to be connected to an outlet exhaust gas port of an engine, mounting means for mounting each header to said engine, each header also having a passage extending completely through the header and disposed generally normal to said inlet, a plurality of tubes interconnecting said headers, each tube having a uniform exterior diameter throughout its length, a first of said tubes being slidably disposed in one end of each passage and a second of said tubes being slidably disposed in the other end of said passage, whereby the adjacent ends of said first and second tubes are in spaced proximate relation at the center portion of said header, stop means disposed within said passage and positioned to be engaged by said tubes to space said adjacent ends apart.

7. The construction of claim 6, wherein the ends of each tube are provided with recesses disposed in communication with the inlet in the respective header, whereby exhaust gas entering said inlet can flow into said tubes.

8. The construction of claim 7, and including means interconnecting the header and the respective tubes for preventing rotation of said tubes relative to the header and maintaining communication between said recesses and said inlet.

9. The construction of claim 6, wherein said stop means comprises a pair of longitudinally spaced abutments disposed in said passage, the end of each tube having a longitudinally extending slot engageable with an abutment, the spacing between said abutments being such that when the abutments are engaged with the bottom of the slots the adjacent ends of the tubes will be spaced apart to thereby permit axial expansion of said tubes.

* * * * *